US008638273B2

(12) United States Patent
Geer

(10) Patent No.: US 8,638,273 B2
(45) Date of Patent: Jan. 28, 2014

(54) ANTENNA SEAL ASSEMBLY AND METHOD OF MAKING THE SAME

(75) Inventor: David John Geer, Johnsonburg, PA (US)

(73) Assignee: General Electric Company, Schenectady, NY (US)

( * ) Notice: Subject to any disclaimer, the term of this patent is extended or adjusted under 35 U.S.C. 154(b) by 385 days.

(21) Appl. No.: 13/028,300

(22) Filed: Feb. 16, 2011

(65) Prior Publication Data

US 2012/0206316 A1 Aug. 16, 2012

(51) Int. Cl.

| | |
|---|---|
| ***H01Q 1/12*** | (2006.01) |
| *H01R 13/66* | (2006.01) |
| *H01R 13/52* | (2006.01) |

(52) U.S. Cl.

USPC ..... 343/888; 439/620.03; 439/271

(58) Field of Classification Search

USPC ..... 343/888

See application file for complete search history.

(56) References Cited

U.S. PATENT DOCUMENTS

| | | | | |
|---|---|---|---|---|
| 5,817,920 | A * | 10/1998 | Kuisell et al. | 73/23.31 |
| 6,862,937 | B2 | 3/2005 | Fujita et al. | |
| 7,364,451 | B2 * | 4/2008 | Ring et al. | 439/271 |
| 7,456,790 | B2 | 11/2008 | Isono et al. | |
| 2008/0040014 | A1 | 2/2008 | Yahata et al. | |
| 2008/0297955 | A1 | 12/2008 | Ausserlechner | |
| 2009/0142960 | A1 * | 6/2009 | Yazawa et al. | 439/620.03 |

* cited by examiner

*Primary Examiner* — Jerome Jackson, Jr.
*Assistant Examiner* — Ricardo Magallanes
(74) *Attorney, Agent, or Firm* — Hiscock & Barclay LLP

(57) ABSTRACT

An antenna and method of making the same is disclosed wherein the antenna includes a seal assembly comprising a seal plate to prevent material used to form a seal around the conductor element from entering into the air gap of the antenna body.

20 Claims, 2 Drawing Sheets

ANTENNA SEAL ASSEMBLY AND METHOD OF MAKING THE SAME

BACKGROUND OF THE INVENTION

The subject matter disclosed herein relates to signal transmitting and receiving devices, and more particularly, to a seal assembly for an antenna and the method of making the same.

Devices for transmitting or receiving signals, such as antennas, are used in many diverse applications, including applications where the attenuation level of a signal is measured as between two antennas. For example, the attenuation of a radio frequency ("RF") signal can be used to monitor certain performance characteristics of filters, such as diesel particulate filters ("DPF").

A DPF is a device designed to trap and remove diesel particulate matter (i.e., soot) from the exhaust gas of diesel engines as the exhaust gas passes through the DPF in order to reduce emissions and improve efficiency. Since a DPF must periodically be cleaned when the soot loading of the DPF exceeds a certain threshold, a DPF monitoring system with DPF sensors can be employed to monitor the soot loading of a DPF. In a DPF monitoring system using RF signals, the power of an RF signal transmitted by an antenna located on one side of the DPF is compared to the power of that RF signal received by an antenna located on the other side of the DPF to measure the attenuation in the signal caused by the DPF. A DPF sensor or engine control module can then correlate the attenuation caused by the DPF with the amount of soot loading of the DPF. For example, a particular attenuation value caused by the DPF coupled with other data (e.g., temperature across the DPF) indicates a particular amount of soot loading of the DPF. Once the soot loading reaches a certain threshold as determined by the measured attenuation and other factors, the DPF must be cleaned or replaced.

Typically, these DPF monitoring systems are calibrated to account for noise and other system inconsistencies to manage the overall performance, reliability, and quality of the data collected, e.g., during operation of the DPF monitoring system. This calibration can take into account, for example, reflection of the RF signal that occurs as a result of an impedance mismatch between the coaxial cable and the antenna, which are each designed to have matching characteristic impedances of 50 ohms to minimize reflection of a portion of the signal back into the coaxial cable. Ideally, two antennas of the same construction and produced by the same manufacturing process would have the same characteristic impedance. But based on differences that result from the manufacturing process, antennas of the same construction often have varying characteristic impedances.

One source of the variability in characteristic impedance between antennas is the use of a slug (e.g., made of glass) to form a seal around the conductor element (i.e., the transmitting or receiving element), sealing the antenna body and forming an air gap around the conductor element. The configuration (e.g., shape and dimensions) of this air gap determines the characteristic impedance of the antenna. During manufacturing, the slug is melted and flows around the conductor element to form a seal. A portion of the seal material can also slump or flow into the air gap of the antenna body, which impacts the characteristic impedance and related reflectivity, of the antenna. For example, one antenna where the seal slumps further into the air gap than another antenna will have a different reflectivity than the other antenna. In existing antenna manufacturing processes, the distance that the seal slumps into the air gap varies from antenna to antenna, which results in significant variability between antennas.

Based on the differences in characteristic impedance between antennas, one antenna having a particular characteristic impedance might produce one attenuation reading while a replacement antenna having a different characteristic impedance might produce a different attenuation reading. Accordingly, when an existing antenna is replaced by a new antenna or when the existing antenna fails or requires maintenance, it is necessary to recalibrate the monitoring system since the characteristic impedance of the new antenna likely differs from the characteristic impedance of the existing antenna. This calibration takes time and resources, and often requires specific equipment and technical knowledge that are not necessarily available or cost effective to provide on-site. In addition, this variability in characteristic impedance can increase the amount of reflection of the signal caused by the impedance mismatch between the coaxial cable and the antenna. Reflection can disrupt the RF signal conduction and reduce the sensitivity of the antenna. Therefore, there is a need to reduce the variability between antennas, including the variability in reflectivity caused by variability in the depth that the seal slumps into the air gap of an antenna when forming a seal.

The discussion above is merely provided for general background information and is not intended to be used as an aid in determining the scope of the claimed subject matter.

BRIEF DESCRIPTION OF THE INVENTION

An antenna is disclosed, wherein the antenna includes a seal assembly comprising a seal plate to prevent material used to form a seal around the conductor element from entering into the air gap of the antenna body. An advantage that may be realized in the practice of some disclosed embodiments of the antenna is reduced variability among antennas of the same construction and produced by the same manufacturing process.

In one exemplary embodiment, an antenna is disclosed. The antenna comprises a conductor element, an antenna body surrounding a portion of the conductor element, a seal located on the interior of the antenna body and surrounding a portion of the conductor element, an air gap bounded by at least the interior of the antenna body, the conductor element, and the seal, and a plate located on the interior of the antenna body and surrounding a portion of the conductor element between the air gap and the seal, wherein the plate prevents the seal from entering the air gap during manufacturing.

In another exemplary embodiment, the antenna comprises a conductor element, an antenna body surrounding a portion of the conductor element, a seal located on the interior of the antenna body and surrounding a portion of the conductor element, a first bore on the interior of the antenna body surrounding the seal, an air gap bounded by at least the interior of the antenna body, the conductor element, and the seal, a plate located on the interior of the antenna body and surrounding a portion of the conductor element between the air gap and the seal, wherein the plate prevents the seal from entering the air gap during manufacturing, and a second bore on the interior of the antenna body surrounding the plate, wherein the diameter of the second bore is smaller than the diameter of the first bore.

In another exemplary embodiment, a method of making an antenna is disclosed. The method comprises the steps of placing a conductor element in the center of the interior of an antenna body of the antenna, forming an air gap between the antenna body and the conductor, placing a plate adjacent to the air gap on the interior of the antenna body and surrounding a portion of the conductor element, placing a seal adjacent to the plate on the interior of the antenna body and surrounding a portion of the conductor element, and heating the seal to flow around the conductor element, wherein the plate prevents the seal from entering into the air gap.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

An antenna is disclosed wherein the antenna includes a seal assembly comprising a seal plate to prevent material used to form a seal around the conductor element from entering into the air gap of the antenna body. An advantage that may be realized in the practice of some disclosed embodiments of the antenna is reduced variability among antennas of the same construction and produced by the same manufacturing process. This reduced variability from antenna to antenna allows antennas in a system to be replaced without significantly changing the performance of the system and/or application, reducing or eliminating the need for recalibrating the system. Another advantage that may be realized in the practice of some disclosed embodiments of the antenna is that the antenna can have a more precise characteristic impedance, which can reduce the amount of reflection caused by impedance mismatches between the coaxial cable and the antenna. Another advantage that may be realized in the practice of some disclosed embodiments of the antenna is the seal plate can help locate the conductor element of the antenna placed in the center of the antenna body and in the center of the air gap during manufacturing, such that the conductor element is evenly spaced from the interior of the antenna body, providing a more precise characteristic impedance.

Figure 1:
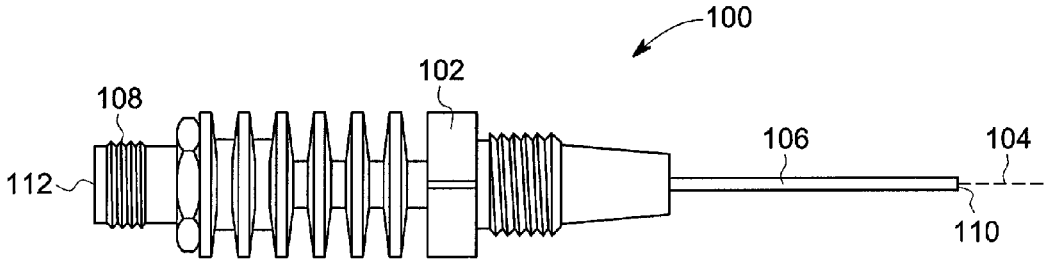
FIG. 1 is a side view of an exemplary embodiment of an antenna.

FIG. 1 is a side view of an exemplary embodiment of an antenna 100 constructed according to one aspect of the invention. The antenna 100 can comprise an antenna body 102 with a longitudinal axis 104, a conductor element 106 for transmitting or receiving a signal (e.g., an RF signal), and a connector 108 (e.g., a TNC connector) for attaching a coaxial cable (not shown) to the conductor element 106. In a typical DPF monitoring system, the connector 108 of the antenna 100 is connected by the coaxial cable to a sensor controller, which can be connected to an engine control module. The antenna 100 has a conductive end 110 at the transmitting or receiving end of the conductor element 106 and a connective end 112 in the connector 108. In one embodiment, the conductor element 106 is made of Inconel alloys and comparable materials.

Figure 2:
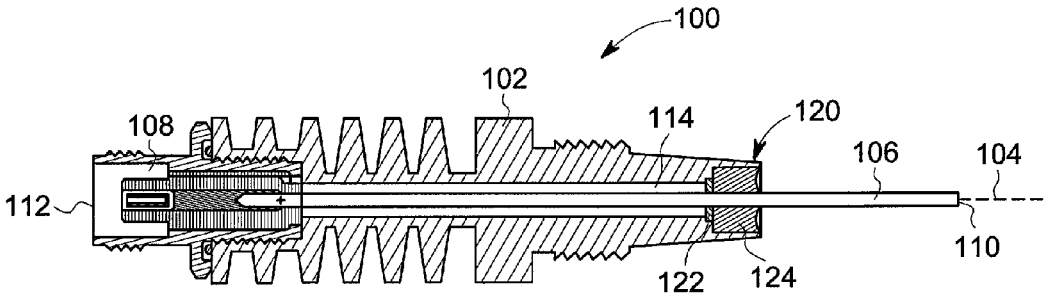
FIG. 2 is a cross-section of the exemplary embodiment of the antenna of FIG. 1.

FIG. 2 is a cross-section of the exemplary embodiment of the antenna 100 of FIG. 1. An air gap 114 is formed in and bounded by the interior of the antenna body 102 surrounding a portion of the conductor element 106 within the antenna body 102 between the connector 108 and a seal assembly 120, which forms a substantially air-tight barrier around the conductor element 106 to form the air gap 114. The structure of the air gap 114 (e.g., the length and volume of the space bounded by the antenna body 102 surrounding the conductor element 106 between the connector 108 and the seal assembly 120) determines the characteristic impedance of the antenna 100 (e.g., 50 ohms).

Figure 3:
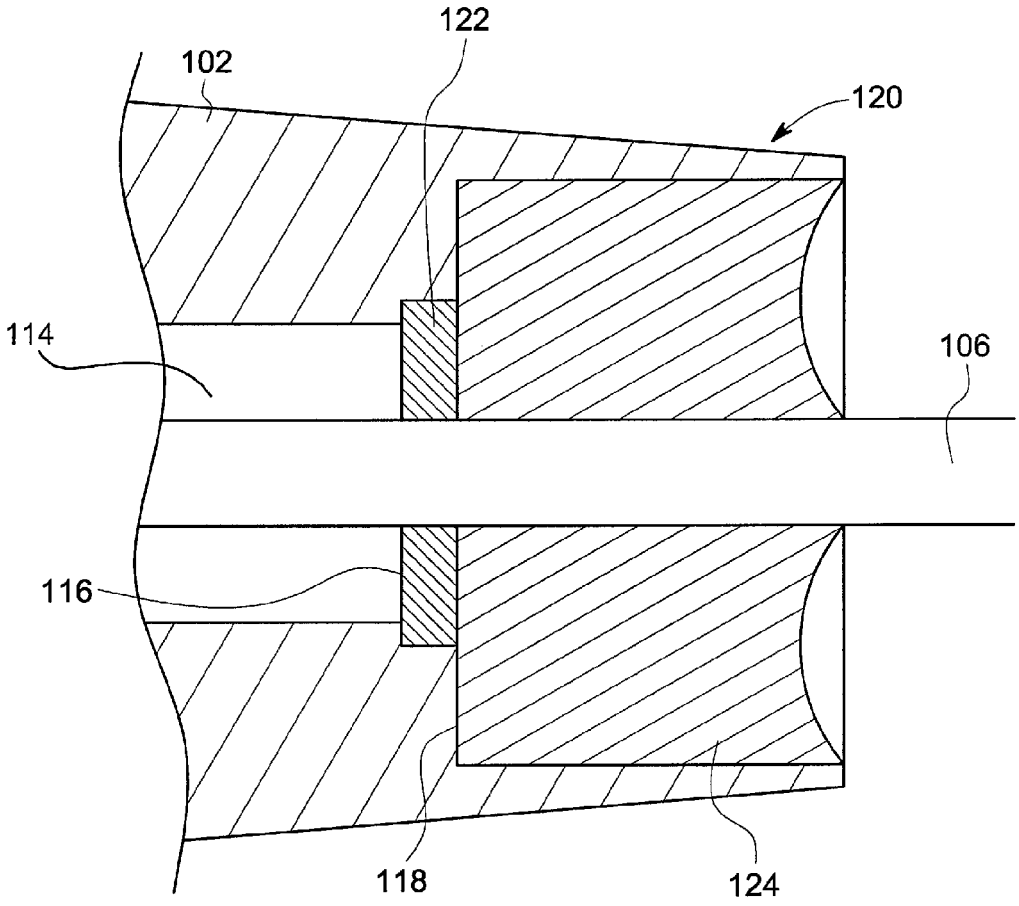
FIG. 3 is an enlarged view of a portion of the exemplary seal assembly of the exemplary embodiment of the antenna of FIGS. 1 and 2.

FIG. 3 is an enlarged view of a portion of the exemplary seal assembly 120 of the exemplary embodiment of the antenna 100 of FIGS. 1 and 2. The seal assembly 120 comprises a seal 124 disposed within a seal bore 118 formed in the interior of the antenna body 102. In one embodiment, the seal 124 is generally constructed so as to fit in the seal bore 118 in the interior of the antenna body 102 and surround a portion of the conductor element 106. In one embodiment, the seal 124 can be made of one or more slugs that include apertures through the seal 124 that are sized to fit over and surround the conductor element 106. The seal 124 can be made from a variety of materials (e.g., glass or similar silica-based materials). When heated during manufacturing, for example using an induction furnace with temperatures as high as 800° C., the seal 124 flows in the seal bore 118 around the conductor element 106 to form a substantially air-tight barrier.

In order to prevent the material of the seal 124 from entering into the air gap 114, a seal plate 122 is located adjacent to and between the air gap 114 and the seal 124. In one embodiment as shown in FIGS. 2 and 3, the seal plate 122 is disposed within a seal plate bore 116 formed in the interior of the antenna body 102. The seal plate 122 and the seal plate bore 116 have a smaller diameter than the seal 124 and the seal bore 118. In that configuration, the seal plate bore 116 is a counterbore to the seal bore 118. In another embodiment, the seal plate 122 and the seal plate bore 116 can have a larger diameter than the seal 124 and the seal bore 118. In yet another embodiment, the seal 124 and the seal plate 122 can have the same diameter, only requiring a single bore (e.g., the seal plate bore 116).

In one embodiment, the seal plate 122 is generally constructed to surround the conductor element 106, such as a seal plate 122 that is ring-shaped with an aperture that is sized to fit over and surround the conductor element 106 (e.g., a washer). In one embodiment, the diameter of the aperture of the seal plate 122 is 0.064 inches (1.63 mm) while the outer diameter of the conductor element 106 is 0.058 in (1.47 mm), providing minimal clearance of 0.006 in (0.16 mm) between the two parts. The seal plate 122 can help locate the conductor element 106 of the antenna 100 placed in the center of the antenna body 102 and in the center of the air gap 114 during manufacturing, such that the conductor element 106 is evenly spaced from the interior of the antenna body 102. The seal plate 122 can be made from a variety of materials (e.g., aluminum oxide (alumina) or other ceramic-based materials) as long as the material does not melt during the manufacturing process. For example, when the seal 124 is heated during manufacturing, the seal 124 will flow in the seal bore 118 around the conductor element 106 to form a substantially air-tight barrier, but will be prevented from entering into the air gap 114 by the seal plate 122. Accordingly, all antennas 100 manufactured with the seal plate 122 will have a uniform air gap 114 that will not vary based on the entry of the seal 124 into the air gap 114 as in existing solutions where the seal 124 can enter into the air gap 114 at different depths, producing different characteristic impedances and performances.

EXPERIMENTAL EXAMPLES

In view of the foregoing, it is further noted that antennas of the type disclosed and contemplated herein can be readily replaced in the DPF monitoring systems discussed previously because of the limited variability between such antennas. To exemplify this favorable level of variability, reference is had to the experimental data collected from experiments conducted in a DPF monitoring system. That is, an RF signal having a frequency swept between 700 mHz and 900 mHz was transmitted from a first antenna positioned on one side of a DPF and received at a second antenna on the other side of the DPF. The level of attenuation (in decibels) was measured, as between the transmitted RF signal and the received RF signal.

Table 1 below summarizes data collected from multiple separate antennas. In experiment 1, each of the antennas were constructed without the seal plate disclosed above, resulting in the seal entering into the air gap at different depths, producing different characteristic impedances and performance between antennas. In experiment 1, the conductor element was pressed to the connector. In experiments 2 and 3, a seal plate was used, preventing the seal from entering into the air gap. In experiment 2, the conductor element was soldered to the connector, while in experiment 3, the conductor element was not soldered to the connector.

TABLE 1

| (Signal Attenuation (dB)) | | | |
|---|---|---|---|
| Antenna | No Seal Plate (Pressed) Experiment 1 | Seal Plate (Soldered) Experiment 2 | Seal Plate (Not Soldered) Experiment 3 |
| 1 | −19.5075 | −17.7339 | −18.7719 |
| 2 | −19.0676 | −17.7852 | −18.7123 |
| 3 | −19.5218 | −17.6939 | −18.7906 |
| 4 | −19.5546 | −17.7404 | −18.8276 |
| 5 | −19.2686 | −17.6862 | −18.7906 |
| 6 | −19.2373 | −17.7384 | −18.7750 |
| 7 | −19.2785 | −17.6974 | −18.7898 |
| 8 | −19.3804 | −17.6475 | −18.8069 |
| 9 | −19.3122 | −17.7746 | −18.7987 |
| 10 | −19.4998 | −17.7432 | −18.7998 |
| 11 | — | −17.7478 | −18.6841 |
| 12 | — | −17.7561 | −18.7647 |

TABLE 1-continued

| (Signal Attenuation (dB)) | | | |
|---|---|---|---|
| Antenna | No Seal Plate (Pressed) Experiment 1 | Seal Plate (Soldered) Experiment 2 | Seal Plate (Not Soldered) Experiment 3 |
| Average | −19.3628 | −17.7287 | −18.7760 |
| Std Dev | 0.1576 | 0.03986 | 0.04042 |

Examining the data of Table 1, it is seen that the variability of the antennas that did not utilize a seal plate (experiment 1) was far greater than the variability of the antennas that did utilize a seal plate (experiments 2 and 3). For example, the standard deviation value for experiment 1 (without a seal plate) was approximately four times greater than the standard deviation value for experiments 2 and 3 (with a seal plate). The date of Table 1 also demonstrates that the attenuation in the antennas that did not utilize a seal plate (experiment 1) was far greater than the attenuation of the antennas that did utilize a seal plate (experiments 2 and 3), since the antennas with the seal plates had better impedance matching and less reflectivity.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. For example, although the exemplary embodiment of the antenna disclosed can be used in a DPF monitoring system, it will be understood that the inventive antenna can be used in a variety of other applications as well. Similarly, while the sealing material is glass in the exemplary embodiment, it will be understood that the inventive antenna can use other types of sealing materials. Such other examples are intended to be within the scope of the claims if they have structural elements that do not differ from the literal language of the claims, or if they include equivalent structural elements with insubstantial differences from the literal language of the claims.

What is claimed is:

1. An antenna comprising:

a conductor element;

an antenna body surrounding a portion of the conductor element, the antenna body separated from the conductor element to form an air gap therebetween;

a seal located at a first end of the air gap between the interior of the antenna body and the conductor element, the seal in contact with the interior of the antenna body and with the conductor element to seal the first end of the air gap;

a connector located at a second end of the air gap opposite the first end of the air gap, the connector disposed between the interior of the antenna body and the conductor element, the connector in contact with the interior of the antenna body and with the conductor element to form a substantially air tight barrier with the conductor element at the second end of the air gap;

the air gap bounded by at least the interior of the antenna body, the conductor element, the connector and the seal; and a plate located on the interior of the antenna body and surrounding a portion of the conductor element between the air gap and the seal, wherein the plate prevents the seal from entering the air gap when the seal is melted.

2. The antenna of claim 1, further comprising:

a first bore on the interior of the antenna body surrounding the seal; and a second bore on the interior of the antenna body surrounding the plate.

3. The antenna of claim 2, wherein the diameter of the second bore is smaller than the diameter of the first bore.

4. The antenna of claim 1, further comprising a first bore on the interior of the antenna body surrounding the seal and the plate.

5. The antenna of claim 1, wherein the seal further comprises an aperture through which a portion of the conductor element extends.

6. The antenna of claim 1, wherein the plate further comprises an aperture through which a portion of the conductor element extends.

7. The antenna of claim 1, wherein the seal is made of at least in part of a silica-based material.

8. The antenna of claim 7, wherein the silica-based material is glass.

9. The antenna of claim 1, wherein the plate is made of at least in part of a ceramic-based material.

10. The antenna of claim 9, wherein the ceramic-based material is aluminum oxide.

11. The antenna of the claim 1, wherein the plate is ring-shaped with an aperture surrounding a portion of the conductor element, the ring-shaped plate comprises an outside diameter greater than a diameter of the air gap, and wherein the aperture comprises a diameter smaller than the diameter of the air gap.

12. The antenna of claim 1, wherein the plate locates the conductor element in the center of the antenna body and in the center of the air gap.

13. An antenna comprising:

a conductor element;

an antenna body surrounding a portion of the conductor element, the antenna body separated from the conductor element to form an air gap therebetween;

a seal located at a first end of the air gap between the interior of the antenna body and the conductor element, the seal in contact with the interior of the antenna body and with the conductor element to seal the first end of the air gap;

a connector located at a second end of the air gap opposite the first end of the air gap, the connector disposed between the interior of the antenna body and the conductor element, the connector in contact with the interior of the antenna body and with the conductor element to form a substantially air tight barrier with the conductor element at the second end of the air gap;

a first bore on the interior of the antenna body surrounding the seal;

the air gap bounded by at least the interior of the antenna body, the conductor element, the connector and the seal;

a plate located on the interior of the antenna body and surrounding a portion of the conductor element between the air gap and the seal, wherein the plate prevents the seal from flowing into the air gap when the seal is melted; and a second bore on the interior of the antenna body surrounding the plate, wherein the diameter of the second bore is smaller than the diameter of the first bore.

14. The antenna of claim 13, wherein the plate further comprises an aperture through which a portion of the conductor element extends.

15. The antenna of claim 13, wherein the seal is made of at least in part of a silica-based material.

16. The antenna of claim 15, wherein the silica-based material is glass.

17. The antenna of claim 13, wherein the plate is made of at least in part of a ceramic-based material which does not melt when the seal is melted.

18. The antenna of claim 17, wherein the ceramic-based material is aluminum oxide.

19. A method of making an antenna comprising the steps of:

placing a conductor element in the center of the interior of an antenna body of the antenna, forming an air gap between the antenna body and the conductor;

placing a plate adjacent to a first end of the air gap on the interior of the antenna body and surrounding a portion of the conductor element, the plate comprising an outside diameter greater than a diameter of the air gap and an aperture having a diameter smaller than the diameter of the air gap, the aperture having the conductor element passing therethrough;

placing a connector adjacent to a second end of the air gap, the connector in contact with the interior of the antenna body and with the conductor element to form a substantially air tight barrier at the second end of the air gap;

placing a seal adjacent to the plate on the interior of the antenna body and surrounding a portion of the conductor element; and heating the seal to flow around the conductor element, wherein the plate prevents the seal from entering into the air gap.

20. The method of making an antenna of claim 19, wherein the plate locates the conductor element in the center of the antenna body and in the center of the air gap.

* * * * *